US009273699B2

(12) United States Patent
Meuter et al.

(10) Patent No.: US 9,273,699 B2
(45) Date of Patent: Mar. 1, 2016

(54) HELICO-AXIAL PUMP, A ROTOR FOR A HELICO-AXIAL PUMP, METHOD FOR THE HYDRODYNAMIC JOURNALLING OF A ROTOR OF A HELICO-AXIAL PUMP, AS WELL AS A HYBRID PUMP WITH A ROTOR FOR A HELICO-AXIAL PUMP

(75) Inventors: Paul Meuter, Seuzach (SE); Christopher David Radcliffe, Leeds (GB); Mônica Alves de Lima Ruguê, Mellingen (SE); Thomas Welschinger, Radolfzell (DE)

(73) Assignee: Sulzer Management AG, Winterthur (CH)

( * ) Notice: Subject to any disclaimer, the term of this patent is extended or adjusted under 35 U.S.C. 154(b) by 1259 days.

(21) Appl. No.: 13/091,010

(22) Filed: Apr. 20, 2011

(65) Prior Publication Data

US 2011/0280706 A1 Nov. 17, 2011

(30) Foreign Application Priority Data

May 11, 2010 (EP) ..... 10162518

(51) Int. Cl.

| | |
|---|---|
| ***F04D 31/00*** | (2006.01) |
| ***F04D 29/047*** | (2006.01) |
| ***F04D 29/057*** | (2006.01) |
| ***F04D 29/66*** | (2006.01) |

(52) U.S. Cl.

CPC ..... *F04D 31/00* (2013.01); *F04D 29/047* (2013.01); *F04D 29/057* (2013.01); *F04D 29/668* (2013.01); *F04D 29/669* (2013.01)

(58) Field of Classification Search

CPC ..... F01D 1/026; F01D 1/02; F01D 1/34; F01D 5/06; F04D 3/00; F04D 19/002; F04D 19/02; F04D 19/007

USPC ..... 415/198.1, 199.1, 199.2, 199.3, 199.4, 415/199.5; 416/198 R, 201 R, 201 A, 198 A

See application file for complete search history.

(56) References Cited

U.S. PATENT DOCUMENTS

| | | | | |
|---|---|---|---|---|
| 4,606,700 | A * | 8/1986 | Brudny-Chelyadinov et al. | 415/199.5 |
| 5,253,977 | A * | 10/1993 | Chaix | 415/199.5 |
| 6,273,672 | B1 | 8/2001 | Charron | |
| 2002/0187037 | A1 | 12/2002 | Lee | |
| 2004/0258518 | A1 | 12/2004 | Buchanan | |

FOREIGN PATENT DOCUMENTS

| | | | |
|---|---|---|---|
| DE | 2 312 546 | A1 | 10/1974 |
| FR | 2 697 870 | A1 | 5/1994 |

* cited by examiner

*Primary Examiner* — Edward Look
*Assistant Examiner* — Christopher J Hargitt
(74) *Attorney, Agent, or Firm* — Kilpatrick Townsend & Stockton LLP

(57) ABSTRACT

The invention relates to a helico-axial pump (1) for pumping a multi-phase mixture (M), said helico-axial pump (1) including a rotor (2) rotatably journalled in a pump housing (6) about a longitudinal axis (A), wherein the rotor (2) includes a compression stage (K) with a helico-axial impeller (3) and a stator (4) for the compression of the multi-phase mixture (M). In accordance with the invention a hydrodynamic stabilization element (7, 71, 72, 73) having a stabilization surface (700) is provided in the pump housing (6) and designed such that a stabilization gap (8) is formed upstream of the stabilization medium, so that in the operating state a hydrodynamic stabilization layer (S) can be formed from a stabilization medium in the stabilization gap (S). The invention further relates to a rotor (2) for a helico-axial pump (1), a method for the hydrodynamic journaling of a rotor (2) of a helico-axial pump (1) as well as to a hybrid pump with a rotor (2) for a helico-axial pump 1.

16 Claims, 9 Drawing Sheets

Figure 1A:
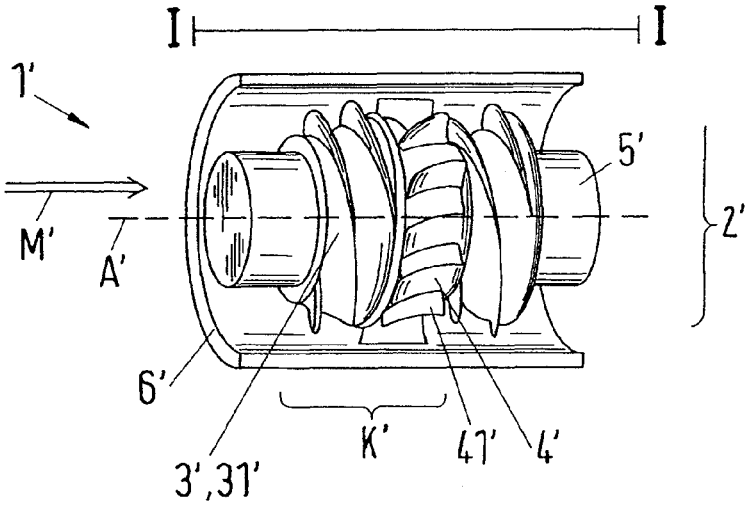

HELICO-AXIAL PUMP, A ROTOR FOR A HELICO-AXIAL PUMP, METHOD FOR THE HYDRODYNAMIC JOURNALLING OF A ROTOR OF A HELICO-AXIAL PUMP, AS WELL AS A HYBRID PUMP WITH A ROTOR FOR A HELICO-AXIAL PUMP

CROSS REFERENCE TO RELATED APPLICATIONS

This application claims the priority of European Application No. 10 162 518.4, filed on May 11, 2010, the disclosure of which is incorporated herein by reference.

The invention relates to a helico-axial pump for pumping multi-phase mixtures, to a rotor for a helico-axial pump, to a method for the hydrodynamic journaling of a rotor of a helico-axial pump and also to a hybrid pump with a rotor for a helico-axial pump in accordance with the preamble of the independent claims.

In the pumping of multi-phase mixtures, such as for example raw oil, which beside crude oil also include natural gas and often also water and solid constituents such as sand, the problem arises that the degree of efficiency of the pumping apparatus used decreases with an increase in the proportion of gas. For example at low gas densities the use of pump apparatus in radial impellers is already no longer possible or rather no longer economical from a volumetric gas/liquid gas ratio of greater than 0.04 to 0.06. For this reason the gaseous phase of the multi-phase mixture is initially separated from the liquid one in conventional pumping facilities having a higher gas ratio and the two phases are then pumped separately under respectively different pumping conditions. This kind of separation of the liquid and gaseous phases of the multi-phase mixtures is dependent on the special conditions of use at the pumping location and is not always possible or economical. For this reason special pumping apparatuses or compression apparatuses were developed in order to reduce the volumetric gas/liquid ratio of the multi-phase mixtures to be pumped to such an extent that a conventional pumping device can be subsequently used for the further pumping, for example a positive displacement pump, a rotary pump or an injector pump.

Such pumping devices or compression devices for multi-phase mixtures having an increased gas ratio are already known from GB-A-1 561,282, EP 0 486 877 or U.S. Pat. No. 5,961,282 for example.

For example the hybrid pump according to U.S. Pat. No. 5,961,282 is a system for the compression of a multi-phase mixture which can, in particular include a considerable gas ratio in addition to a liquid phase. In this respect the pump includes a multi-stage axial flow pump for the reduction of the relative gas ratio, i.e. the axial flow pump serves to increase the density of the multi-phase mixture, so that it can subsequently be pumped from a low level to a higher level by a further ordinary centrifugal pump, for example from the bottom of the sea to an oil platform, a ship or to a land-based installation.

As has already been mentioned, the helico-axial pump acting as a compressor includes a rotor with a plurality of compression stages, in practice for example with as many as sixteen or more stages, so that the multi-stage mixture can be compressed gradually from a relatively low density having a high relative gas volume ratio to a highly compressed multi-phase mixture having such a high density that the highly compressed mixture can be pumped further having a normal feed pump.

Figure 1B:
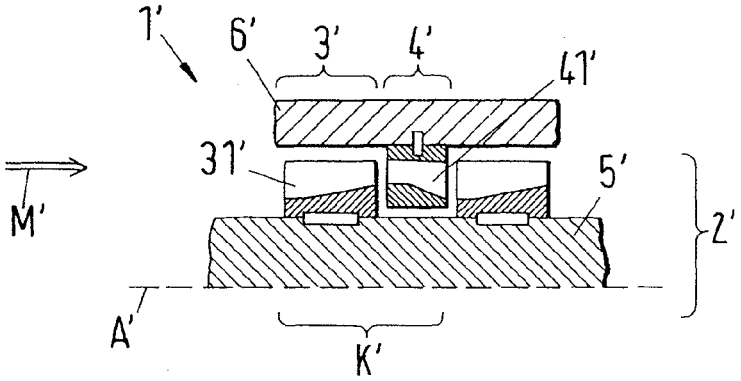

A general known compression stage K' of a rotor 2' of a helico-axial pump 1' is schematically illustrated in FIG. 1*a* and FIG. 1*b*, wherein for purposes of clarification a section I-I of a section in accordance with FIG. 1*a* is shown parallel to the longitudinal axis A' in FIG. 1*b*.

In this respect each compression stage K' includes a rotating impeller 3' with a screw 31', wherein the rotating impeller 3' is similar to a short Archimedes' screw and a stator 4' connected to this, which includes a plurality of static, in other words non rotating blades 41'. In this respect the impeller 3' and the stator 4' are mounted relative to a common pump shaft 5' in such a way that in the operating state the impeller 3' is displaced into rotation by the pump shaft 5', while the stator 4' is uncoupled by the rotational movement of the pump shaft 5' and thus does not rotate relative to impeller 3'. In this respect the pump shaft 5' extends along a longitudinal axis A'. In this respect the plurality of the compression stages K' are arranged in series one behind the other in a substantially tube-like pump housing 6'.

The rotating screw 31' pumps the multi-phase mixture M' in the direction of the arrow out of a previous compression stage K' not shown in FIG. 1*a* and FIG. 1*b* for example into the stator 4', by means of which kinetic energy is converted to pressure energy in the stator 4', which leads to the compression of the multi-phase mixture M'.

To achieve a sufficiently high compression of the multi-phase mixture M', in practice, as has already been mentioned, a larger number of, for example, as many as sixteen or even more compression stages K', each including an impeller 3' and a stator 4' have to be provided in series, which inevitably leads to a considerable overall length of the helico-axial pump 1'.

The critical disadvantage of such long rotors 2' formed from a plurality of compression stages K' is thus that they can only be controlled with difficulty with regard to oscillations. These long rotors 2' namely form a system which is capable of oscillating in the centre of the tube-like pump housing, which can in particular form different transversal modes of oscillation, which can be so intensive that the pump can no longer be operated at a pre-determined rotational speed or in a particular field of rotation. Furthermore, the degree of efficiency of the pumps 1' can also be reduced and in the worst case damage to the pump 1' is to be feared, if for example the rotor 2' starts to oscillate so strongly and uncontrollably that parts of the rotor 2', such as the impellers 3' come into contact for example with the pump housing due to the oscillating movement. In this respect the nature and intensity of the oscillations of the rotor 2' do not only depend on the special geometry but also on the operating state of the pump 1', on the multi-phase mixture M' to be pumped, on the rotational speed of the pump 1' and on further known and in part not precisely known parameters, so that it is hardly possible to fully master the problems with the damaging oscillations of the rotor 2' just with an adaptation of the geometrical proportions of the known pump 1' or through the use of new materials.

It is therefore the object of the invention to provide a helico-axial pump for pumping multi-phase mixtures, in which the damaging oscillations of the rotor are largely avoided and the oscillations of the rotor are reduced or attenuated to a pre-determinable degree, so that a higher degree of efficiency of the pump and/or an improved running of the rotor in the operating state is achieved. A further object of the invention is to provide a rotor for a helico-axial pump, a method for the hydrodynamic journaling of a rotor of a helico-axial and also a hybrid pump having a rotor for a helico-axial pump, by means of which the problems of the oscillations of the rotor known from the prior art are avoided.

The subject matter of the invention satisfying this object are characterized by the features of the independent claims 1, 11, 14 and 15.

The dependent claims relate to particularly advantageous embodiments of the invention.

The invention thus relates to a helico-axial pump for pumping a multi-phase mixture, said helico-axial pump including a rotor rotatably journalled in a pump housing about a longitudinal axis, wherein the rotor includes a compression stage with a helico-axial impeller and a stator for the compression of the multi-phase mixture. In accordance with the invention a hydrodynamic stabilization element having a stabilization surface is provided in the pump housing and is designed such that a stabilization gap is formed upstream of the stabilization surface, so that in the operating state a hydrodynamic stabilization layer can be formed from a stabilization medium in the stabilization gap.

It is thus crucial for the invention that a hydrodynamic stabilization element having a stabilization surface is provided in the pump housing, so that a stabilization gap is formed upstream of the stabilization surface, in which in the operating state of the pump a hydrodynamic stabilization layer is formed in the stabilization gap. For the formation of the hydrodynamic stabilization layer a highly compressed multi-phase mixture is particularly preferably already used which is taken from a compression stage in which the multi-phase mixture is already more strongly compressed than it will be compressed in the step in which it is used for the formation of the stabilization layer. However, alternatively or simultaneously a multi-phase mixture can be used which is compressed in one and the same compression stage for the formation of the hydrodynamic stabilization layer, which will be explained in detail, for example with reference to FIG. 2. Special passages or pipes can e.g. be provided for this in or at the pump housing, which connect a supply aperture for the feeding of the multi-phase mixture into the stabilization gap with the pressure output of a pre-determinable compression stage.

In this respect it goes without saying that in special cases the stabilization medium for the formation of the stabilization layer can also be made available by other external sources, for example by a pressure reservoir or by a pump, which make available the medium for the formation of the stabilization layer for the introduction into the stabilization layer under a controllable and/or variable pressure. The medium for the formation of the stabilization layer does also not have to be the multi-phase mixture to be pumped, but can also be another stabilization medium, for example an oil, water or another liquid or gaseous stabilization medium or fluid.

Thus the dynamics of the rotor are decisively improved by the present invention, because the attenuation and rigidity of the rotor system which is unable to oscillate is significantly increased.

The damaging oscillations of the rotor are thus largely avoided and are at least reduced or attenuated to a pre-determinable tolerable degree, so that the pump can be operated even at a number of revolutions or in a certain field of rotation, where that has so far not been possible without the use of the stabilization layer in accordance with the invention. Furthermore potentially even a higher efficiency factor of the pump and a smoother running of the rotor in the operating state can be achieved. Naturally, this ultimately means that not only can energy be conserved for the operation of the pump, but the intervals between servicing can also be extended, thus drastically reducing the costs associated with this and also considerably increasing the life expectancy of the pump.

In this respect the degree, or rather the strength of the attenuation can be adapted in a simple manner in a helico-axial pump in accordance with the invention, depending on the technical requirements or specifications. This can, for example, take place by means of a suitable choice of the geometry, for example of the geometrical shape or width of the stabilization gap. Or moreover, e.g. by means of a valve known per se, the pressure of the multi-phase mixture introduced into the stabilization gap is controlled and/or regulated. It is also possible, for example, to alternatively or simultaneously convey the multi-phase mixture from different compression stages to the stabilization gap, whereby the pressure in the stabilization gap and thus the degree of the attenuation or the rigidity of the rotor capable of oscillating can be adjusted likewise in a very simple way and can be adjusted very flexibly to the different requirements and changing operating conditions.

A further particular advantage is that the invention makes it possible for the first time to construct pumps with a much greater number of compression stages than was previously possible. Until now the possible number of compression stages was limited by the oscillations of the rotor which massively increased with the increasing number of compression stages. The rotor can be securely stabilized practically at any length by means of the invention.

Using certain embodiments it is even possible to upgrade existing pumps from the prior art, so that, the whole pump does not have to be exchanged, in order to be able utilize the advantage of the invention. This is e.g. possible in that a rotor in accordance with the invention, for example a rotor with a cover ring at the helico-axial impeller is simply adjusted to the geometry of a known older pump and installed within the scope of a regular service. This means, the older rotor, which has the problems with the damaging oscillations described at the beginning of this specification, can simply be exchanged for a rotor of the present invention.

As will be explained in the following with the aid of the drawings by way of example of particularly preferred embodiments, the stabilization gap can be provided between the stabilization surface and the pump housing for example and/or be provided between the stabilization surface and the rotor.

In a particularly important embodiment for practical use, the stabilization element is a cover ring, which surrounds the helico-axial impeller in the circumferential direction, so that the stabilization gap is formed between the cover ring and the pump housing. In this respect a cover ring such as this can be provided on all helico-axial impellers of a rotor or only be provided on selected individual impellers, whereby the manufacture of the rotor naturally becomes considerably less complex and more economical.

In a different important embodiment of the present invention the stabilization element is provided in the form of a stabilization sleeve between two adjacent compression steps at the rotor. Wherein a stabilization sleeve can be provided between all adjacent compression steps of a rotor, whereby a particularly good damping of the oscillation of the rotor can achieved, in particular for very high loads or, however, a stabilization sleeve can only be provided between individually selected pairs of compression steps, through which the manufacture of the rotor naturally becomes significantly less complex and more economical.

In this respect the stabilization sleeve can be designed and arranged on the rotor such that the stabilization gap is formed between the stabilization sleeve and the pump housing and/or the stabilization sleeve can also be designed and arranged at the rotor such that the stabilization gap is formed between the stabilization sleeve and the rotor. In this particular case both variants can be realized, thus allowing particularly smooth running and particularly good attenuation of the rotor oscillations.

As already mentioned in the above, in a particularly preferred variant of the present invention a feed passage can be provided, which is formed and arranged such that a multi-phase mixture can be pumped at a pre-determinable pressure and the pre-determinable amount of multi-phase mixture resulting from this through the feed passage to the stabilization gap for the formation of the hydrodynamic stabilization layer in the stabilization gap, wherein the feed passage is preferably provided in a gap ring.

Thus the stabilization element can be designed as a stator having a feed passage for example, wherein the feed passage is formed and arranged at the stator such that at a pre-determinable pressure a pre-determinable amount of stabilization medium, in particular of multi-phase mixture can be pumped through the feed passage to the stabilization gap for the formation of the hydrodynamic stabilization layer in the stabilization gap.

In a further variant the feed passage can be arranged and formed at the pump housing such that for the formation of a hydrodynamic stabilization layer in the stabilization gap a predeterminable amount of stabilization medium can be pumped to the stabilization gap, in particular a multi-phase mixture can be pumped to the stabilization gap via the feed passage.

Or however a feed passage is arranged and designed at the rotor such that a pre-determinable amount of stabilization medium, in particular of a multi-phase mixture can be pumped through the feed passage to the stabilization gap for the formation of the hydrodynamic stabilization layer in the stabilization gap.

As has already been mentioned, in a helico-axial pump in accordance with the invention the stabilization medium, in particular the multi-phase mixture can particularly preferably be fed to the feed passage from a compression stage, at which a higher level of pressure prevails than at those compression stages to which it is pumped as stabilization medium. Alternatively or at the same time, however, a compressed multi-phase mixture can be used in one and the same compression stage for the formation of the hydrodynamic stabilization layer.

The invention further relates to a rotor for the arrangement in a pump housing of a helico-axial pump as is described within the scope of this invention, wherein the rotor includes a compression stage with a helico-axial impeller and a stator for the compression of the multi-phase mixture. In accordance with the invention a hydrodynamic stabilization element with a hydrodynamic stabilization layer is formed and arranged at the rotor such that a stabilization gap is formed upstream of the stabilization layer in the installed state of the rotor, so that in the operating state of the rotor a hydrodynamic stabilization layer can be formed from a stabilization medium present in the stabilization gap.

The stabilization element is particularly preferably a cover ring, which surrounds the helico-axial impeller in the circumferential direction, so that the stabilization gap is formed between the cover ring and a pump housing of the helico-axial pump, wherein at the same time or alternatively the stabilization element can also be formed as a stabilization sleeve between two adjacent compression stages at the rotor.

In a special embodiment of a rotor in accordance with the invention a feed passage can also be provided, which is formed and arranged such that a pre-determinable amount of stabilization medium, in particular of a multi-phase mixture can be pumped through the feed passage to the stabilization gap for the formation of the hydrodynamic stabilization layer in the stabilization gap. Corresponding pipes can be provided at or in the rotor for example, for pumping the stabilization medium or the rotor shaft can have suitable bores for example, or can be designed completely or partially as a hollow rotor shaft for the conveying and pumping of the stabilization medium.

The invention further relates to a hybrid pump having a rotor in accordance with the invention.

Furthermore, the invention also relates to a method for the hydrodynamic journaling of a rotor of the present invention, wherein the rotor is rotatably journalled about a longitudinal axis in a pump housing and the rotor includes a compression stage with a helico-axial impeller and a stator. In accordance with the invention, a hydrodynamic stabilization element with a stabilization layer is provided and arranged in the pump housing such that a stabilization gap is formed upstream of the stabilization surface, so that in the operating state a hydrodynamic stabilization layer is formed out of a stabilization medium in the stabilization gap for the hydrodynamic journaling of the rotor.

Figure 2:
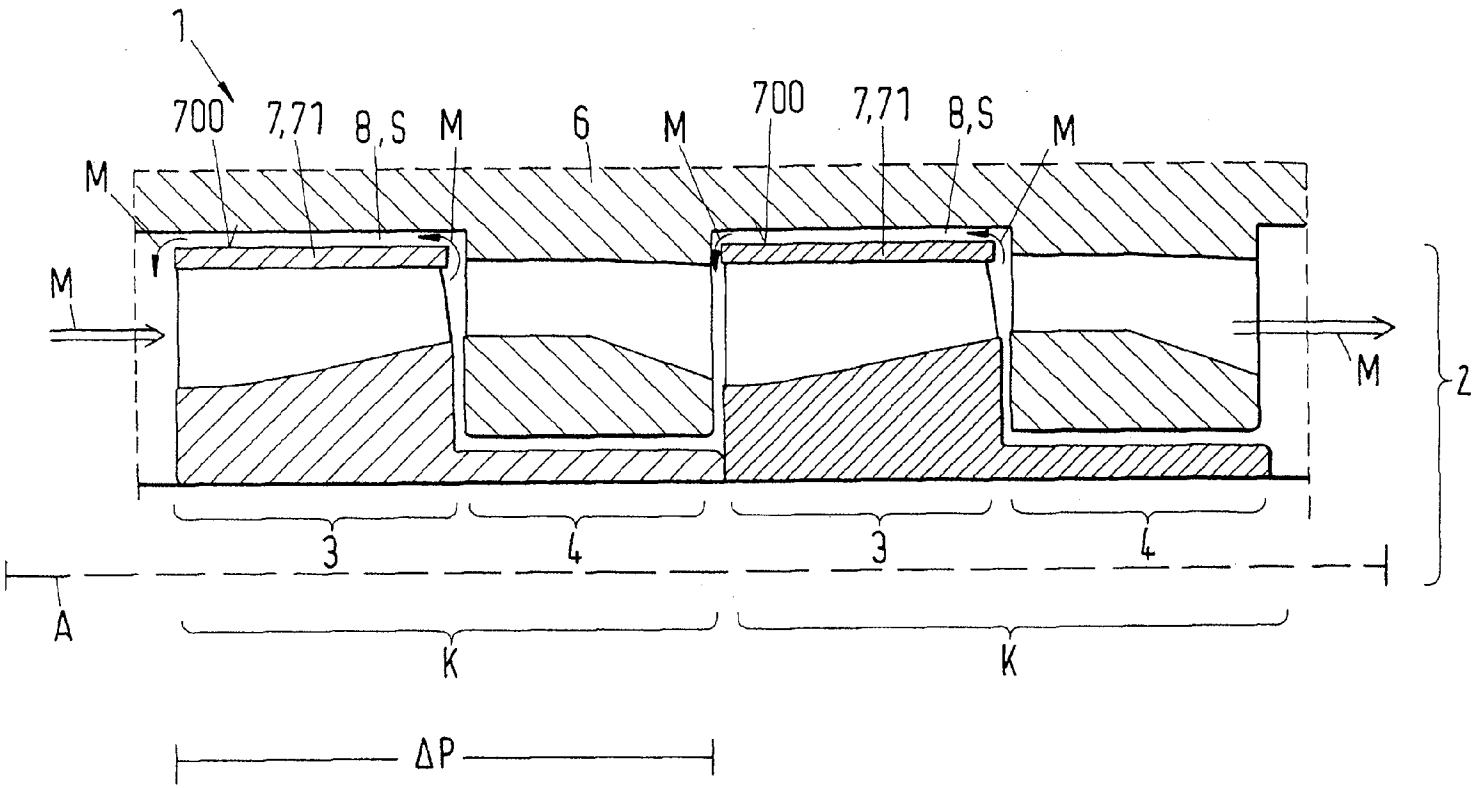
Figure 3:
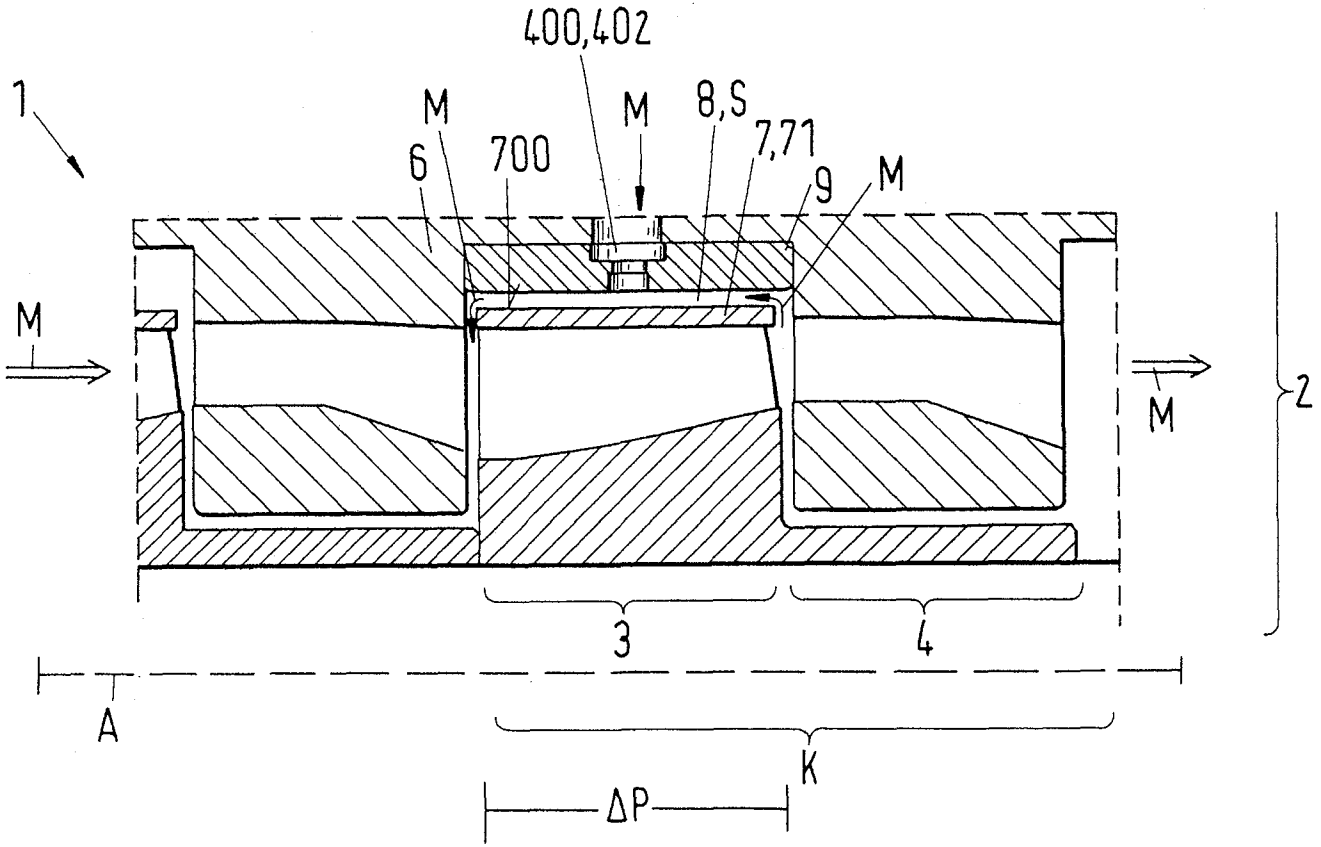
Figure 3A:
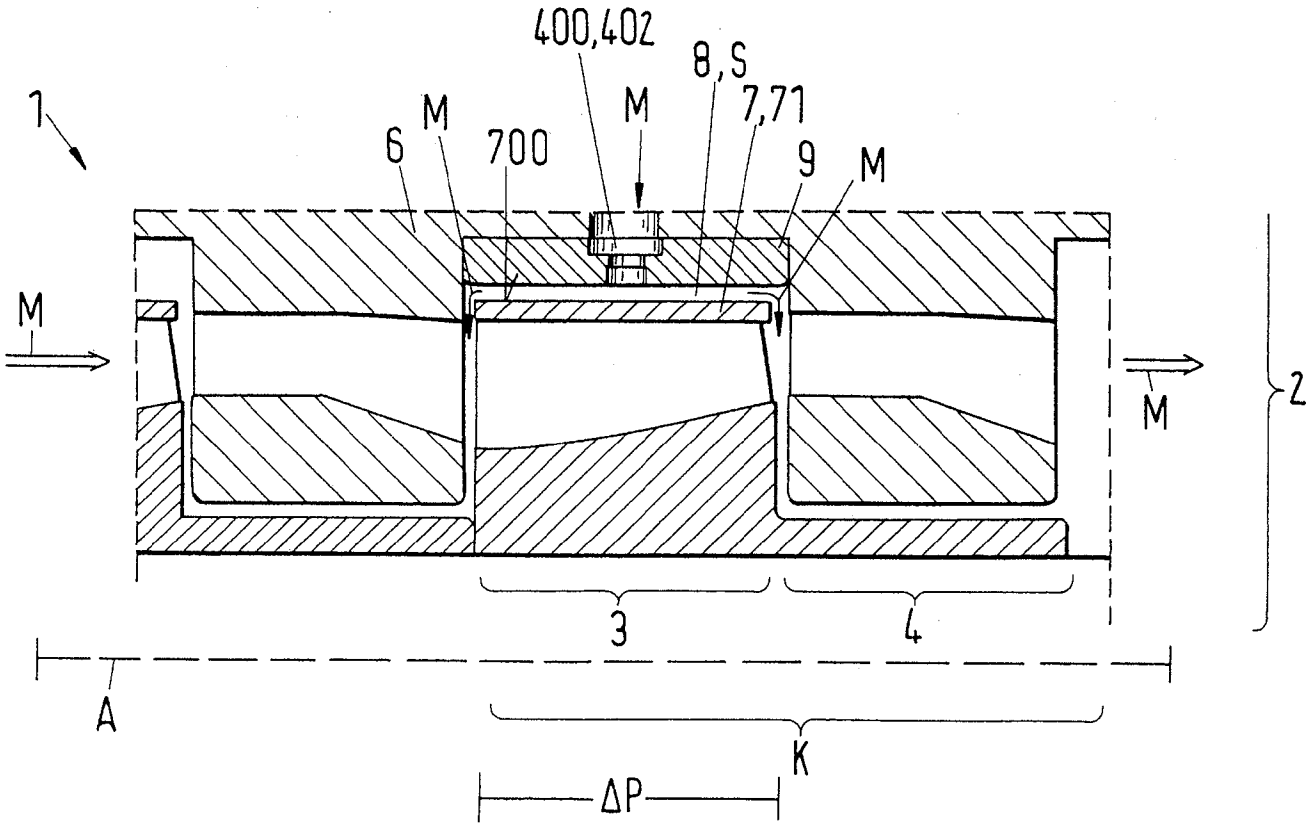
Figure 4A:
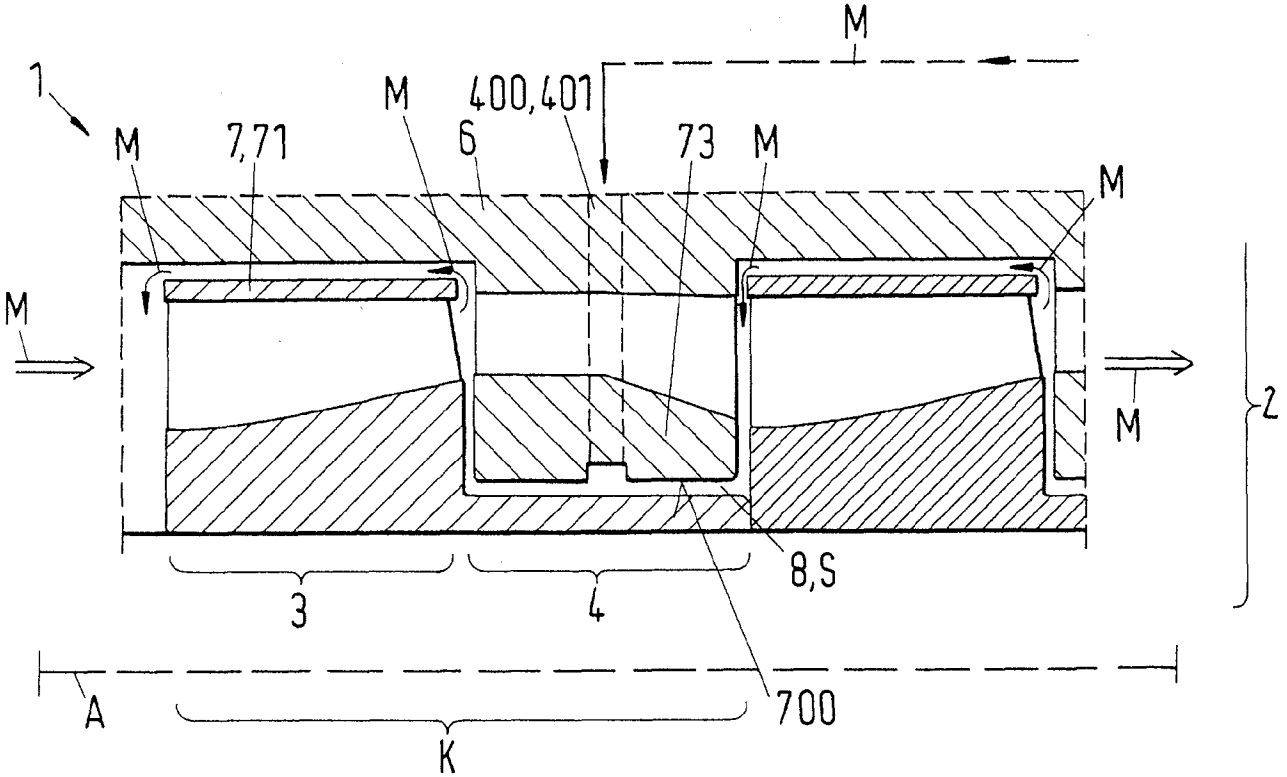
Figure 4B:
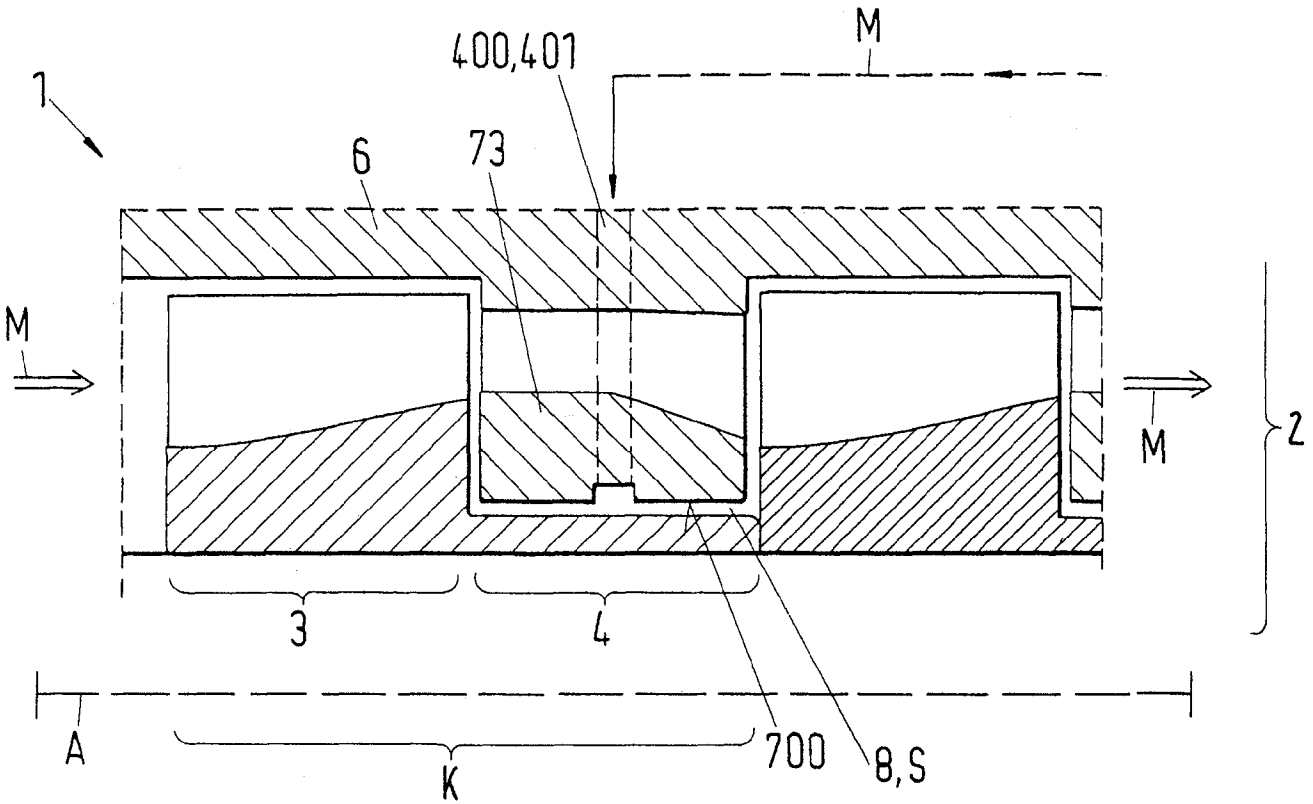
Figure 4C:
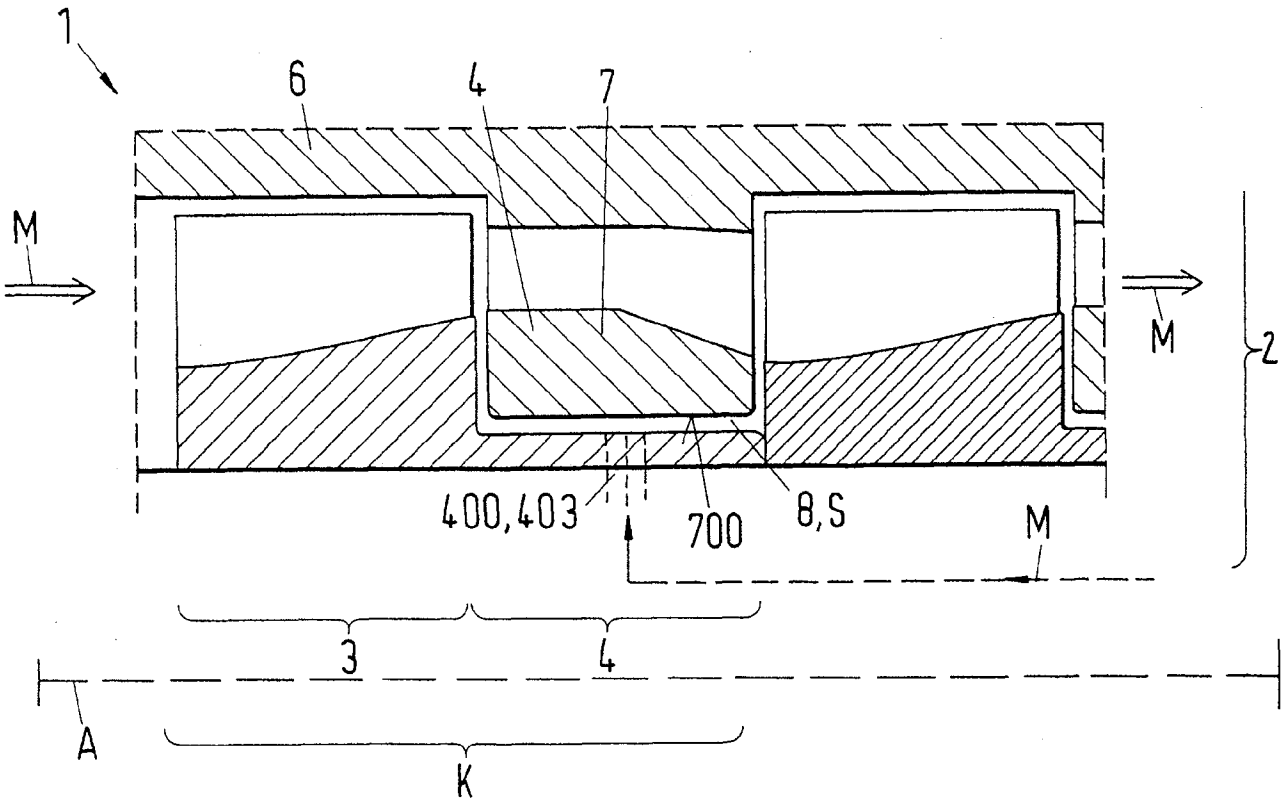
Figure 5A:
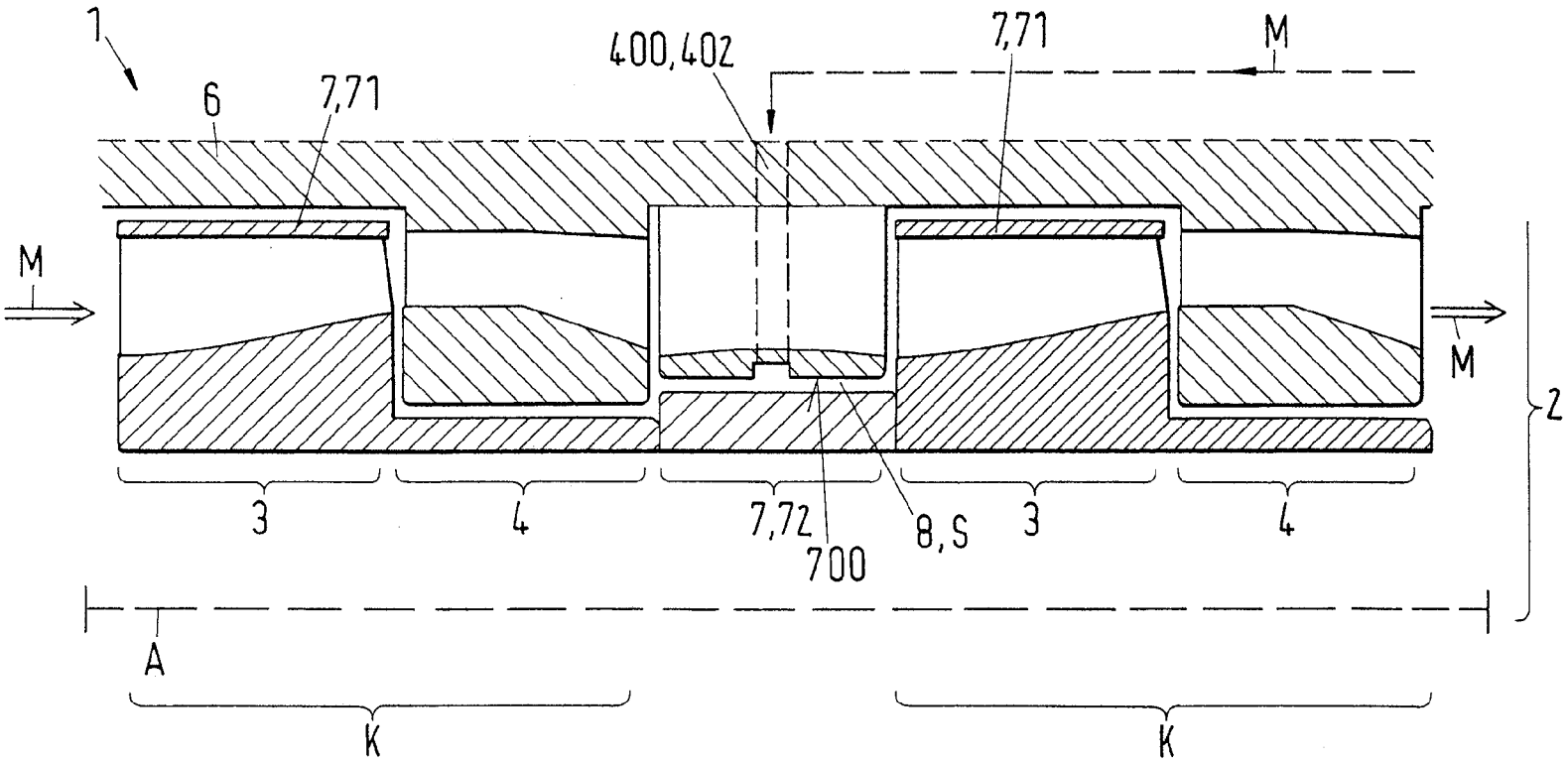
Figure 5B:
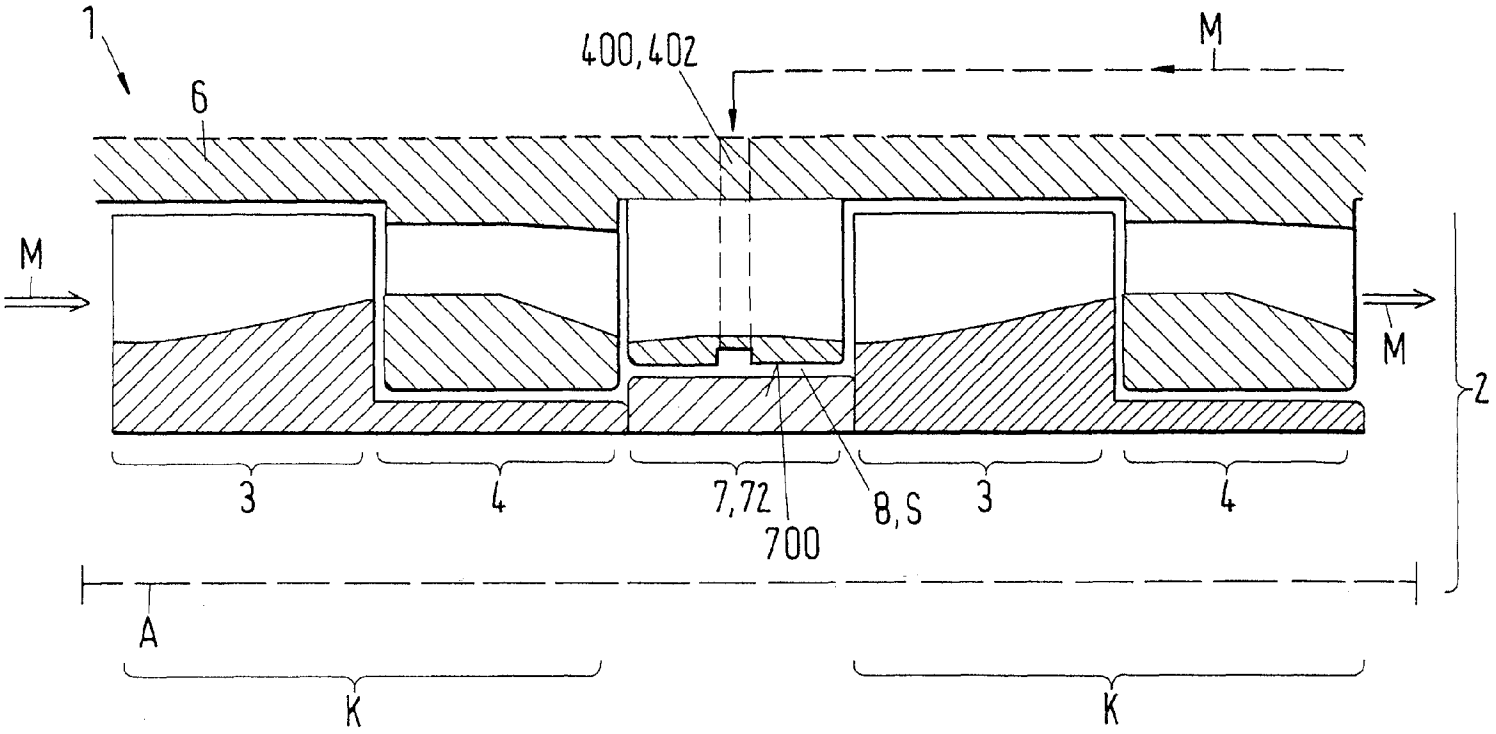

In the following the invention will be explained in detail with reference to the drawings, which show, in schematic illustration:

FIG. 1*a* a compression stage of a helico-axial pump known from the prior art;

FIG. 1*b* a pump in accordance with FIG. 1*a* partly in section;

FIG. 2 an embodiment of a helico-axial pump in accordance with the invention with a cover ring on the helico-axial impeller;

FIG. 3 a second embodiment in accordance with FIG. 2 with injection on the cover ring of the helico-axial impeller;

FIG. 3*a* the embodiment of FIG. 3 with injection at high pressure;

FIG. 4*a* a third embodiment in accordance with FIG. 2 with injection at the stator;

FIG. 4*b* another embodiment in accordance with FIG. 4*a* without a cover ring on the helico-axial impeller;

FIG. 4*c* a further embodiment in accordance with FIG. 4*b* with injection from the rotor;

FIG. 5*a* a fourth embodiment in accordance with FIG. 2 having a stabilization sleeve and injection;

FIG. 5*b* a different embodiment in accordance with FIG. 5*a* without a cover ring at the helico-axial impeller.

The prior art described with the help of FIGS. 1*a* and 1*b* has already been described in detail at the beginning of this specification, so that a further discussion of FIGS. 1*a* and 1*b* is not necessary here.

Furthermore, it should be pointed out here that, for purposes of better differentiation of the invention from the prior art in the drawings, those reference numerals which relate to features or embodiments from the prior art, are provided with an apostrophe, whereas reference numerals of features of embodiments in accordance with the invention do not have an apostrophe.

With the aid of FIG. 2 a first important embodiment of a helico-axial pump in accordance with the invention is to be discussed, which is characterized by a cover ring at the helico-axial impeller.

The helico-axial pump 1 for pumping a multi-phase mixture M includes a rotor 2 rotatably journalled in a pump housing 6 about a longitudinal axis A. In this respect the rotor 2 includes, in a manner known per se, a compression stage K with a helico-axial impeller 3 and a stator 4 for the compression of the multi-phase mixture M. In accordance with the present invention in this respect a hydrodynamic stabilization element 7, 71 having a stabilization surface 700 is provided and arranged in the pump housing 6 in such a way that a stabilization gap 8 is formed upstream of the stabilization surface 700, so that in the operating state a hydrodynamic stabilization layer S made of a stabilization medium M can be formed in the stabilization gap 8.

In the present example of FIG. 2 the stabilization element 7 is a cover ring 71, which surrounds the helico-axial impeller 3 in a circumferential direction, so that the stabilization gap 8 can be formed between the cover ring 71 and the pump housing 6.

For reasons of clarity only one or two compression stages K are respectively illustrated in all the figures In this respect. Even if it is, in principle, possible that a helico-axial pump 1 in accordance with the invention only includes a single compression stage K, a helico-axial pump 1 will in practice include a plurality of compression stages K, for example as many as sixteen compression stages K or even considerably more compression stages K, which are preferably arranged in series one after the other along the longitudinal axis A, so that a sufficient overall compression of the multi-phase mixture M can be produced in a manner known per se and the multi-phase mixture M can then be pumped using a pressure pump switched in series to a higher level for example and/or over long distances for further processing.

In the embodiment in accordance with FIG. 2 the stabilization layer S is formed of the stabilization medium in the stabilization gap 8 in that the multi-phase mixture is, fed from the left-hand side of the drawing to the left-hand compression stage K in the drawing as is shown symbolically by the double arrow M, compressed by this in a manner known per se, which naturally results in a corresponding increase in pressure, which also establishes itself as the pressure difference ΔP above the helico-axial impeller 3 compression stage K.

Due to the pressure difference ΔP, as indicated by the small curved arrow M, the higher pressure level shown on the right-hand side of the drawing, the multi-phase mixture M is pressed into the stabilization gap 8, so that the hydrodynamic stabilization layer S automatically forms between the stabilization surface 700 of the cover ring 7 and the pump housing 6, through which the oscillations of the rotor are attenuated and the running of the rotor is stabilized.

In this respect it is understood that in a rotor 2 of the present invention the cover ring can either be formed on all helico-axial impellers 3 of the rotor, or only on certain selected helico-axial impellers 3. Furthermore, depending on the use or depending on the special requirements, the cover ring 71 can completely cover a helico-axial impeller 3 or cover a certain pre-determinable region of the circumference of the helico-axial impeller 3.

A second embodiment according to FIG. 2 is illustrated schematically in accordance with FIG. 3, which differs from FIG. 2 in that an injection of the stabilization medium is provided at the cover ring 71 of the helico-axial impeller 3. Additionally, a stabilization medium is introduced here through the feed passage 400, 402 into the stabilization gap 8 for the formation of the stabilization layer S. It is to be understood that as was already described in the discussion of FIG. 2, a pressure difference ΔP above the helico-axial impeller 3 compression stage K will also occur here in the operating state, by means of which the stabilization layer S is already partly formed. Through the use of the injection of stabilization medium at a raised pressure through the feed passage 400, however, an even better stabilization layer S can be constructed in the stabilization gap 8, so that very long rotors 2 or very stressed rotors 2 can be adequately attenuated and securely journalled.

In this respect the embodiment of FIG. 3*a* is distinguished from those of FIG. 3 only in that the injection of the stabilization medium at the cover ring 71 of the helico-axial impeller 3 takes place at a considerably higher pressure than in the example of FIG. 3. This can clearly be seen from the fact that according to the drawing of FIG. 3*a* the stabilization medium is not only pressed out of the stabilization gap 8 towards the left, in other words towards a compression stage K with a low pressure level, but also towards the right, in others words also towards a compression stage with a higher pressure level.

On the other hand, in the example of FIG. 3 the pressure with which the stabilization medium is pumped through the feed passage 400, 402 into the stabilization gap 8 for the formation of the stabilization layer S is considerably smaller than in FIG. 3*a*. This can be clearly seen in that in FIG. 3 the stabilization medium can enter the stabilization gap 8 from the right-hand side of the drawing, in other words from a compression stage with a higher pressure level.

As has already been described, In this respect the stabilization medium can also be made available by an external pressure reservoir or an external pump, however, it is preferably made available by another compression stage K, which has a higher pressure level.

A third embodiment in accordance with FIG. 2 with an injection of the stabilization medium at the stator 4 is shown with the aid of the schematic FIG. 4*a*. A feed passage 400, 401 in the shape of a bore is provided here at the stator 4, for example at an impeller of the stator 4 or, however, a separate feed passage 400, 401 can also be provided, which, as shown in FIG. 4*a*, extends through the pump housing 6 to the stabilization gap 8, so that a stabilization layer S made of stabilization medium in accordance with the invention, which, in the special embodiment of FIG. 4*a* is a multi-phase mixture M from a different compression stage can be formed between the rotor 2 and the stabilization surface 700 of the stator 4 formed as a stabilization element 73.

Another embodiment in accordance with FIG. 4*a* is illustrated in FIG. 4*b*, which differs from that of FIG. 4*a* only in that no cover ring 71 is provided at the helico-axial impeller 3. Such a simplified construction can e.g. always be used if the stablilization of the rotor 2 by the stabilization layer S on the rotor 4 is already sufficient.

FIG. 4*c* shows a further variant of the embodiment in accordance with FIG. 4*b*. Here the pumping of the stabilization medium does not take place via a feed passage 400, 401 through the pump housing 6, but rather the injection of the stabilization medium takes place through a feed passage 400, 403, which is formed in the rotor 2. For this purpose the rotor 2 can have a hollow rotor shaft for example, or suitable passages or pipes can be formed in the rotor shaft, through which the stabilization medium, for example a multi-phase mixture M, can be pumped out from a compression stage K with a higher pressure level.

In contrast FIG. 5*a* shows a fourth, different embodiment in accordance with FIG. 2, in which an additional stabilization sleeve 72 is provided between two adjacent compression stages K, wherein the injection of the stabilization medium into the stabilization gap 8 takes place through a feed passage 400, 402 guided through the pump housing 6. Such an arrangement is particularly suitable if a very high stability and/or attenuation of the rotor 2 has to be achieved. In this respect the injection into to the stabilization gap 8 can in principle also take place along the lines of FIG. 4*c* through the rotor shaft of the rotor 2. Moreover, it is naturally also possible, as is schematically shown in FIG. 5*b*, that the cover ring can be dispensed with at all helico-axial impellers 3 or different helico-axial impellers 3.

In this respect it goes without saying that in special cases it is also possible, that as an alternative to, or in addition to the stabilization sleeve 72 arranged between two adjacent compression stages K, a stabilization sleeve 72 can also be provided between the helico-axial impeller 3 and the stator 4. In this respect the person of ordinary skill in the art understands at once that a stabilization sleeve 72 does not have to be provided at each compression stage K, nor between every pair of compression stages K.

It is understood that all the embodiments of the invention described above are only to be understood as examples and the invention includes in particular, but not only, all suitable combinations of the embodiments described.

The invention claimed is:

1. A helico-axial pump for pumping a multi-phase mixture, said helico-axial pump comprising:

a pump housing;

a rotor rotatably journalled in the pump housing about a longitudinal axis, wherein the rotor includes a compression stage having a helico-axial impeller;

a stator for the compression of the multi-phase mixture; and a hydrodynamic stabilization element having a stabilization surface, disposed in the pump housing in such a way that a stabilization gap is formed upstream of the stabilization surface, so that in the operating state a hydrodynamic stabilization layer made of a stabilization medium can be formed in the stabilization gap.

2. The helico-axial pump in accordance with claim 1, wherein the stabilization gap is formed between the stabilization surface and the pump housing and/or wherein the stabilization gap is formed between the stabilization surface and the rotor.

3. The helico-axial pump in accordance with claim 1, wherein the stabilization element is a cover ring which surrounds the helico-axial impeller in a circumferential direction, so that the stabilization gap is formed between the cover ring and the pump housing.

4. The helico-axial pump in accordance with claim 1, wherein the stabilization element is a stabilization sleeve between two adjacent compression stages on the rotor.

5. The helico-axial pump in accordance with claim 4, wherein the stabilization sleeve is configured in such a way, and disposed on the rotor so that the stabilization gap is formed between the stabilization sleeve and the pump housing and/or wherein the stabilization sleeve is configured in such a way, and disposed on the rotor so that the stabilization gap is formed between the stabilization sleeve and the rotor.

6. The helico-axial pump in accordance with claim 1, wherein the stabilization element is the stator having a feed passage, which is formed and arranged at the stator in such a way that a pre-determinable amount of stabilization medium can be pumped to the stabilization gap through the feed passage for the formation of the hydrodynamic stabilization layer in the stabilization gap.

7. The helico-axial pump in accordance with claim 1, wherein a feed passage is arranged and formed on the pump housing in such a way that a pre-determinable amount of stabilization medium can be pumped to the stabilization gap through the feed passage for the formation of the hydrodynamic stabilization layer in the stabilization gap.

8. The helico-axial pump in accordance with claim 1, further comprising a feed passage configured in such a way that a pre-determinable amount of stabilization medium can be pumped to the stabilization gap through the feed passage for the formation of the hydrodynamic stabilization layer in the stabilization gap.

9. The helico-axial pump in accordance with claim 8, wherein the feed passage is provided in a split ring.

10. The helico-axial pump in accordance with claim 8, wherein the stabilization medium is pumped to the feed passage by a compression stage, at which a higher pressure level prevails.

11. A rotor for the arrangement in the pump housing of the helico-axial pump in accordance with claim 1, comprising the compression stage with the helico-axial impeller and the hydrodynamic stabilization element.

12. The rotor in accordance with claim 11, wherein the stabilization element is a cover ring, which surrounds the helico-axial impeller in the circumferential direction, so that the stabilization gap is formed between the cover ring and the pump housing of the helico-axial pump.

13. The rotor in accordance with claim 11, wherein a feed passage is provided and configured such that a pre-determinable amount of stabilization medium can be pumped to the stabilization gap through the feed passage for the formation of the hydrodynamic stabilization layer in the stabilization gap.

14. The rotor in accordance with claim 11, wherein the stabalization element is disposed on the rotor and configured as a stabilization sleeve between two adjacent compression stages.

15. A hybrid pump, comprising:

a pump housing;

a rotor rotatably journalled in the pump housing about a longitudinal axis, wherein the rotor includes a compression stage having a helico-axial impeller;

a stator for the compression of a multi-phase mixture; and a hydrodynamic stabilization element having a stabilization surface, disposed in the pump housing in such a way that a stabilization gap is formed upstream of the stabilization surface, so that in the operating state a hydrodynamic stabilization layer made of a stabilization medium can be formed in the stabilization gap, wherein the hydrodynamic stabilization element is disposed on the rotor and configured such that in the operating state of the rotor the hydrodynamic stabilization layer can be formed from the stabilizing medium in the stabilizing gap.

16. A method for the hydrodynamic journalling of a rotor in a helico-axial pump, the pump comprising a pump housing; a rotor rotatably journalled in the pump housing about a longitudinal axis, wherein the rotor includes a compression stage having a helico-axial impeller; a stator for the compression of the multi-phase mixture; and a hydrodynamic stabilization element having a stabilization surface, disposed in the pump housing in such a way that a stabilization gap is formed upstream of the stabilization surface, so that in the operating state a hydrodynamic stabilization layer made of a stabilization medium can be formed in the stabilization gap, the rotor comprising the compression stage with the helico-axial impeller and the hydrodynamic stabilization element, the method comprising:

rotatably journalling the rotor about the longitudinal axis in the pump housing;

providing the rotor with the compression stage including the helico-axial impeller and the stator for the compression of the multi-phase mixture;

providing the hydrodynamic stabilization element with the stabilization surface in the pump housing;

arranging the stabilization gap upstream of the stabilization surface; and in the operating state, forming the hydrodynamic stabilization layer from the stabilization medium in the stabilization gap for hydrodynamically journalling the rotor.

* * * * *